US012781368B2

(12) United States Patent
Lee et al.

(10) Patent No.: US 12,781,368 B2
(45) Date of Patent: Nov. 3, 2026

(54) HYDROGEN GENERATION AND CARBON DIOXIDE STORAGE SYSTEM FOR PRODUCING ALKALI BICARBONATE

(71) Applicants: HYUNDAI MOTOR COMPANY, Seoul (KR); KIA CORPORATION, Seoul (KR); UIF (University Industry Foundation), Yonsei University, Seoul (KR)

(72) Inventors: Yun Su Lee, Yongin-si (KR); Ji Hoon Jang, Suwon-si (KR); Dongil Lee, Goyang-si (KR); Yongsung Jo, Seoul (KR)

(73) Assignees: HYUNDAI MOTOR COMPANY, Seoul (KR); KIA CORPORATION, Seoul (KP); UIF (University Industry Foundation), Yonsei University, Seoul (KR)

( * ) Notice: Subject to any disclaimer, the term of this patent is extended or adjusted under 35 U.S.C. 154(b) by 720 days.

(21) Appl. No.: 18/229,723

(22) Filed: Aug. 3, 2023

(65) Prior Publication Data

US 2024/0175155 A1 May 30, 2024

(30) Foreign Application Priority Data

Nov. 24, 2022 (KR) ..... 10-2022-0159577

(51) Int. Cl.
*C25B 15/08* (2006.01)
*C25B 1/04* (2021.01)
(Continued)

(52) U.S. Cl.
CPC ..... *C25B 15/085* (2021.01); *C25B 1/04* (2013.01); *C25B 9/19* (2021.01); *C25B 9/67* (2021.01);
(Continued)

(58) Field of Classification Search
CPC ..... C25B 15/085; C25B 1/04; C25B 9/19; C25B 9/67; C25B 11/042; C25B 11/089;
(Continued)

(56) References Cited

U.S. PATENT DOCUMENTS 9,627,728 B2 4/2017 Lu
2015/0183653 A1* 7/2015 Jung ..... C01D 7/07 204/263

FOREIGN PATENT DOCUMENTS

KR 101955695 B1 3/2019
KR 102048797 B1 11/2019
(Continued)

*Primary Examiner* — Prem C Singh
*Assistant Examiner* — Juan C Valencia
(74) *Attorney, Agent, or Firm* — Lempia Summerfield Katz LLC

(57) ABSTRACT

A hydrogen generation and carbon dioxide storage system for producing an alkali bicarbonate is provided. The system may include: a metal-carbon dioxide battery comprising an anode, a cathode, and a separator interposed between the anode and the cathode; a first supplier configured to provide a first electrolyte to the anode; a second supplier configured to provide a second electrolyte to the cathode; a reaction unit configured to manufacture a precursor material by reacting starting materials comprising aqueous alkali carbonate solution and carbon dioxide; a third supplier configured to provide the aqueous alkali carbonate solution to the reaction unit; a fourth supplier configured to provide the carbon dioxide to the reaction unit; and a hydrogen gas separator configured to separate hydrogen gas from a product discharged from the cathode and to provide a remainder of the product to the reaction unit.

18 Claims, 4 Drawing Sheets

(51) Int. Cl.

| | |
|---|---|
| ***C25B 9/19*** | (2021.01) |
| ***C25B 9/67*** | (2021.01) |
| ***C25B 11/042*** | (2021.01) |
| ***C25B 11/089*** | (2021.01) |
| ***C25B 13/08*** | (2006.01) |

(52) U.S. Cl.
CPC ..... *C25B 11/042* (2021.01); *C25B 11/089* (2021.01); *C25B 13/08* (2013.01); *C25B 15/081* (2021.01)

(58) Field of Classification Search
CPC ..... C25B 13/08; C25B 15/081; C25B 15/08; C25B 15/083; C01D 7/10
See application file for complete search history.

(56) References Cited

FOREIGN PATENT DOCUMENTS

| | | | | |
|---|---|---|---|---|
| KR | 102069111 | B1 | 1/2020 | |
| KR | 20200090505 | A | 7/2020 | |
| KR | 102203876 | B1 | 1/2021 | |
| KR | 102245163 | B1 | 4/2021 | |
| WO | WO-2020045945 | A1 * | 3/2020 | ..... H01M 16/00 |

* cited by examiner

HYDROGEN GENERATION AND CARBON DIOXIDE STORAGE SYSTEM FOR PRODUCING ALKALI BICARBONATE

CROSS-REFERENCE TO RELATED APPLICATION

This application claims under 35 U.S.C. § 119(a) the benefit of and priority to Korean Patent Application No. 10-2022-0159577, filed on Nov. 24, 2022, the entire contents of which are incorporated herein by reference.

BACKGROUND

(a) Technical Field

The present disclosure relates to a hydrogen generation and carbon dioxide storage system for producing an alkali bicarbonate.

(b) Background Art

Recently, research on water electrolysis, also known as electrochemical water splitting, is actively underway so as to keep up with development of renewable energy in response to climate change. Further, the importance to carbon dioxide ($CO_2$) capture, storage, and conversion technologies for greenhouse gas reduction continues to grow.

A zinc/aluminum (Zn/Al)-based aqueous battery system is a very economical metal anode candidate in terms of price and deposits. The zinc/aluminum (Zn/Al)-based aqueous battery system simultaneously produces hydrogen and captures carbon dioxide in the form of a salt, such as $KHCO_3$.

The above information disclosed in this Background section is only for enhancement of understanding of the background of the disclosure and therefore may contain information that does not form the prior art that is already known to a person of ordinary skill in the art.

SUMMARY OF THE DISCLOSURE

The present disclosure has been made in an effort to solve the above-described problems associated with the prior art, and it is an object of the present disclosure to provide a hydrogen generation and carbon dioxide storage system which has an improved carbon dioxide throughput compared to conventional systems.

It is another object of the present disclosure to provide a hydrogen generation and carbon dioxide storage system that has an increased alkali bicarbonate output compared to conventional systems.

In one aspect, the present disclosure provides a hydrogen generation and carbon dioxide storage system including: a metal-carbon dioxide battery including an anode, a cathode, and a separator interposed between the anode and the cathode; a first supplier configured to provide a first electrolyte to the anode; a second supplier configured to provide a second electrolyte including protons; an aqueous alkali carbonate solution and an aqueous alkali bicarbonate solution to the cathode; a reaction unit configured to manufacture a precursor material by reacting starting materials including the aqueous alkali carbonate solution and carbon dioxide; a third supplier configured to provide the aqueous alkali carbonate solution to the reaction unit; a fourth supplier configured to provide the carbon dioxide to the reaction unit; and a hydrogen gas separator configured to separate hydrogen gas from a product discharged from the cathode and to provide a remainder of the product to the reaction unit.

In an embodiment, the anode of the battery may include aluminum, zinc, or a combination thereof.

In another embodiment, the cathode of the battery may include carbon paper, carbon fiber, carbon felt, carbon fabric, metal foam, a metal thin film, or combinations thereof. Alternatively, the cathode may include a catalyst metal supported on a support.

In still another embodiment, the separator of the battery may include a cation conductive resin.

In yet another embodiment, the first electrolyte may include an aqueous sodium hydroxide solution, an aqueous potassium hydroxide solution, or a combination thereof.

In still yet another embodiment, the aqueous alkali carbonate solution may include an aqueous sodium carbonate ($Na_2CO_3$) solution, an aqueous potassium carbonate ($K_2CO_3$) solution, or a combination thereof.

In a further embodiment, the aqueous alkali bicarbonate solution may include an aqueous sodium bicarbonate ($NaHCO_3$) solution, an aqueous potassium bicarbonate ($KHCO_3$) solution, or a combination thereof.

In another further embodiment, the second electrolyte may further include bicarbonate ions ($HCO_3^-$) and carbon dioxide.

In still another further embodiment, the second electrolyte may have a pH in a range of 8 to 9.

In yet another further embodiment, the second electrolyte may be configured to be provided to the cathode at a temperature in a range of 0° C., to 25° C.

In still yet another further embodiment, the precursor material may include the aqueous alkali bicarbonate solution, and the aqueous alkali bicarbonate solution may be in a supersaturated state.

In a still further embodiment, the aqueous alkali bicarbonate solution in the second electrolyte may be in a saturated state.

In a yet still further embodiment, third supplier may provide a 0.5 M to 3 M aqueous alkali carbonate solution to the reaction unit.

In another embodiment, the third supplier may provide 0.1 moles to 1 mole of the aqueous alkali carbonate solution to the reaction unit based on 1 mole of hydrogen gas discharged from the hydrogen gas separator.

In still another embodiment, the hydrogen generation and carbon dioxide storage system may further include a filtration unit located between the reaction unit and the second supplier and configured to precipitate and separate an alkali bicarbonate from the precursor material supplied from the reaction unit so as to manufacture the second electrolyte and to provide the second electrolyte to the second supplier.

In yet another embodiment, the filtration unit may include a cooler configured to reduce a temperature of the precursor material so as to precipitate the alkali bicarbonate from the precursor material, and a filter configured to separate the precipitated alkali bicarbonate.

Other aspects and embodiments of the disclosure are discussed infra.

The above and other features of the disclosure are discussed infra.

BRIEF DESCRIPTION OF THE DRAWINGS

The above and other features of the present disclosure are now described in detail with reference to certain exemplary embodiments thereof illustrated in the accompanying drawings which are given hereinbelow by way of illustration only, and thus are not limitative of the present disclosure, and wherein.

Figure 1:
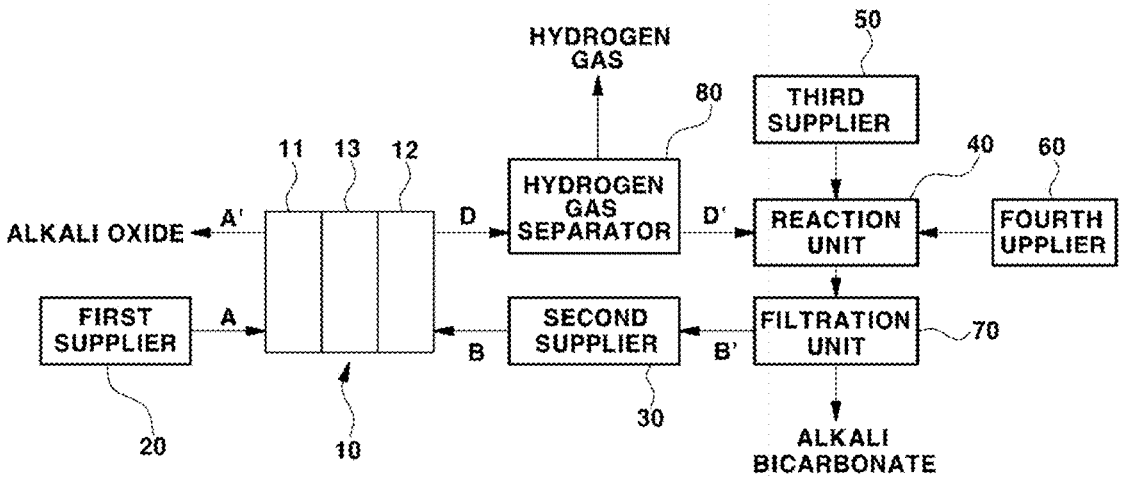
FIG. 1 shows an example of a hydrogen generation and carbon dioxide storage system according to an embodiment of the present disclosure.

It should be understood that the appended drawings are not necessarily to scale, presenting a somewhat simplified representation of various features illustrative of the basic principles of the disclosure. The specific design features of the present disclosure as disclosed herein, including, for example, specific dimensions, orientations, locations, and shapes, are determined in part by the particular intended application and use environment.

In the figures, reference numbers refer to the same or equivalent parts of the present disclosure throughout the several figures of the drawing.

DETAILED DESCRIPTION

The above-described objects, other objects, advantages, and features of the present disclosure are apparent from the descriptions of embodiments given hereinbelow with reference to the accompanying drawings. However, the present disclosure is not limited to the embodiments disclosed herein and may be implemented in various different forms. The embodiments are provided to make the description of the present disclosure thorough and to fully convey the scope of the present disclosure to those skilled in the art.

In the following description of the embodiments, the same elements are denoted by the same reference numerals even when they are depicted in different drawings. In the drawings, the dimensions of structures may be exaggerated compared to the actual dimensions thereof, for clarity of description. In the following description of the embodiments, terms, such as "first" and "second," may be used to describe various elements but do not limit the elements. These terms are used only to distinguish one element from other elements. For example, a first element may be named a second element, and similarly, a second element may be named a first element, without departing from the scope and spirit of the disclosure. Singular expressions may encompass plural expressions, unless they have clearly different contextual meanings.

In the following description of the embodiments, terms, such as "including," "comprising," and "having," are to be interpreted as indicating the presence of characteristics, numbers, steps, operations, elements or parts stated in the description or combinations thereof, and do not exclude the presence of one or more other characteristics, numbers, steps, operations, elements, parts or combinations thereof, or possibility of adding the same. In addition, when a part, such as a layer, a film, a region, or a plate, is said to be "on" another part, the part may be located "directly on" the other part or other parts may be interposed between the two parts. In the same manner, when a part, such as a layer, a film, a region, or a plate, is said to be "under" another part, the part may be located "directly under" the other part or other parts may be interposed between the two parts.

All numbers, values, and/or expressions representing amounts of components, reaction conditions, polymer compositions, and blends used in the description are approximations in which various uncertainties in measurement generated when these values are acquired from different things are reflected, and thus understood that they are modified by the term "about," unless stated otherwise. In addition, if a numerical range is disclosed in the description, such a range includes all continuous values from a minimum value to a maximum value of the range, unless stated otherwise. Further, if such a range refers to integers, the range includes all integers from a minimum integer to a maximum integer, unless stated otherwise.

When a component, device, element, or the like of the present disclosure is described as having a purpose or performing an operation, function, or the like, the component, device, or element should be considered herein as being "configured to" meet that purpose or to perform that operation or function.

FIG. 1 shows a hydrogen generation and carbon dioxide storage system according to the present disclosure. The system includes a metal-carbon dioxide battery 10 including an anode 11, a cathode 12, and a separator 13 interposed between 11 and the cathode 12. In the system, a first supplier 20 is configured to provide a first electrolyte A to the anode 11, and a second supplier 30 is configured to provide a second electrolyte B to the cathode 12.

The anode 11 is an electrode formed of a metal and may include aluminum, zinc, or a combination thereof.

The first supplier 20 may include elements, such as a storage tank configured to accommodate the first electrolyte A, and a pump configured to provide the first electrolyte A to the anode 11.

The first electrolyte A may include an aqueous sodium hydroxide solution, an aqueous potassium hydroxide solution, and a combination thereof.

Oxidation reaction represented by Reaction Equation 1 below may occur at the anode 11. Reaction Equation 1 is expressed on the assumption that the anode 11 is formed of zinc.

$$Zn+4Na^{+}+4OH^{-}\rightarrow 4Na^{+}+Zn(OH)_4^{2-}+2e^{-}$$

$$Zn(OH)_4^{2-}\rightarrow ZnO+H_2O+2OH^{-} \qquad \text{[Reaction Equation 1]}$$

An alkali oxide, such as zinc oxide generated at the anode 11, is discharged to the outside, and alkali cations migrate to the cathode 12 through the separator 13.

The separator 13 is located between the anode 11 and the cathode 12, therein preventing the anode 11 and the cathode 12 from coming into physical contact with each other. Further, the separator 13 prevents the first electrolyte A and the second electrolyte B from being mixed with each other. Additionally, the separator 13 conducts the alkali cations generated at the anode 11 to the cathode 12.

The separator 13 may include a resin having cationic conductivity. For example, the separator 13 may include a perfluorinated sulfonic acid resin, such as Nafion™.

The cathode 12 may induce reaction between the alkali cations having migrated through the separator 13 and the second electrolyte B and may thus produce hydrogen and store carbon dioxide in the form of an alkali bicarbonate.

The cathode 12 may include carbon paper, carbon fiber, carbon felt, carbon fabric, metal foam, a metal thin film, or combinations thereof. Alternatively, the cathode 12 may include a catalyst metal supported on a support. The catalyst metal is not limited to a specific kind, and may include a precious metal, such as platinum (Pt), and/or a transition metal, such as nickel (Ni) or molybdenum (Mo).

The second supplier 30 may include elements, such as a storage tank configured to accommodate the second electrolyte B, and a pump configured to provide the second electrolyte B to the cathode 12.

The second electrolyte B may include protons, an aqueous alkali carbonate solution, an aqueous alkali bicarbonate solution, bicarbonate ions ($HCO_3^-$), and carbon dioxide.

The aqueous alkali carbonate solution may include an aqueous sodium carbonate ($Na_2CO_3$) solution, an aqueous potassium carbonate ($K_2CO_3$) solution, or a combination thereof.

The aqueous alkali bicarbonate solution may include an aqueous sodium bicarbonate ($NaHCO_3$) solution, an aqueous potassium bicarbonate ($KHCO_3$) solution, or a combination thereof.

The present disclosure is characterized in that the second electrolyte B is manufactured by a reaction unit 40, described in greater detail below. In this example, the manufactured second electrolyte is then provided to the cathode 12. Concretely, the system may include the reaction unit 40 configured to manufacture a precursor material by reacting starting materials including the aqueous alkali carbonate solution and carbon dioxide, a third supplier 50 configured to provide the aqueous alkali carbonate solution to the reaction unit 40, a fourth supplier 60 configured to provide carbon dioxide to the reaction unit 40, and a filtration unit 70 located between the reaction unit 40 and the second supplier 30. The filtration unit 70 is configured to precipitate and separate an alkali bicarbonate from the precursor material C supplied from the reaction unit 40 so as to manufacture the second electrolyte B and to provide the second electrolyte B to the second supplier 30.

The reaction unit 40 may cause the dissolution reaction of carbon dioxide, represented by Reaction Equation 2 and Reaction Equation 3. Reaction Equation 2 and Reaction Equation 3 are expressed on the assumption that the aqueous alkali carbonate solution is an aqueous sodium carbonate ($Na_2CO_3$) solution.

$$CO_2+H_2O \rightarrow H^+ + HCO_3^- \quad \text{[Reaction Equation 2]}$$

$$CO_2+Na_2CO_3+H_2O \rightarrow 2NaHCO_3 \quad \text{[Reaction Equation 3]}$$

Therefore, the precursor material C may include unreacted materials, protons, bicarbonate ions, and the alkali bicarbonate, among the starting materials. The alkali bicarbonate may be in an aqueous solution state, or in a precipitated solid state. When the alkali bicarbonate in the precursor material C is in the aqueous solution state, the aqueous solution state may be a supersaturated aqueous solution state. The reason for this is that a product D' discharged from the cathode 12 through a hydrogen gas separator 80, described in greater detail below, is recirculated to the reaction unit 40, the product D' includes the alkali bicarbonate, and thus, the alkali bicarbonate in the product D' is added to the alkali bicarbonate synthesized by Reaction Equation 3.

The reaction unit 40 may include a reaction vessel configured to accommodate the starting materials, a stirrer, a heat exchanger configured to control the temperature of the reaction vessel, etc.

The third supplier 50 may provide a 0.5 M to 3 M aqueous alkali carbonate solution to the reaction unit 40. Further, the third supplier 50 may provide 0.1 moles to 1 mole of the aqueous alkali carbonate solution to the reaction unit 40 based on 1 mole of hydrogen gas discharged from the hydrogen gas separator 80, described in greater detail below. When the concentration and content of the aqueous alkali carbonate solution provided by the third supplier 50 are within the above-described ranges, a desired hydrogen output and a desired carbon dioxide throughput in the present disclosure may be achieved.

The third supplier 50 may include elements, such as a storage tank configured to accommodate the aqueous alkali carbonation solution, and a pump configured to provide the aqueous alkali carbonation solution to the reaction unit 40.

The fourth supplier 60 may supply carbon dioxide to the reaction unit 40. The fourth supplier 60 may provide pure carbon dioxide to the reaction unit 40, or may provide carbon dioxide together with inert gas, such as nitrogen, as a carrier gas to the reaction unit 40.

The fourth supplier 60 may include elements, such as a storage tank configured to accommodate the carbon dioxide, and a pump configured to provide the carbon dioxide to the reaction unit 40.

Here, the carbon dioxide is not limited to a specific flow rate, and the fourth supplier 60 may provide the caron dioxide to the reaction unit 40, for example, at a flow rate in a range of 10 mL/min to 100 mL/min.

The reaction unit 40 may provide the above-manufactured precursor material C to the filtration unit 70.

The filtration unit 70 may include a cooler configured to reduce the temperature of the precursor material C so as to precipitate the alkali bicarbonate from the precursor material C, and a filter configured to separate the precipitated alkali bicarbonate.

Because the aqueous alkali bicarbonate solution included in the precursor material C is in a supersaturated state, when the cooler reduces the temperature of the precursor material C, the solubility of the alkali bicarbonate is reduced, and thus, the alkali bicarbonate is precipitated. The precipitated alkali bicarbonate may be easily separated and recovered by the filter.

The cooler may reduce the temperature of the precursor material C to a temperature in a range of 0° C. to 25° C., or in a range of 5° C. to 10° C.

The second electrolyte B may be acquired by precipitating and separating the alkali bicarbonate from the precursor material C. The aqueous alkali bicarbonate solution included in the second electrolyte B may be in a saturated state.

The second electrolyte B may have a pH in a range of 8 to 9, and may have a temperature in a range of 0° C. to 25° C., or in a range 10° C. to 25° C.

When the second electrolyte B is provided to the cathode 12, hydrogen gas is generated by Reaction Equation 4 below, and carbon dioxide is stored in the form of a salt by Reaction Equation 5 below.

$$2H^+ + 2e^- \rightarrow H_2 \quad \text{[Reaction Equation 4]}$$

$$2Na^+ + Na_2CO_3 + 3CO_2 + 3H_2O \rightarrow 4Na^+ + 4HCO_3^- + 2H^+ \rightarrow 4NaHCO_3 + 2H^+$$

$$Na^+ + HCO_3 \rightarrow NaHCO_3 \quad \text{[Reaction Equation 5]}$$

Therefore, a product D discharged from the cathode 12 may include unreacted materials, protons, and the aqueous alkali bicarbonate solution, among the second electrolyte B.

The system may include the hydrogen gas separator 80 located between the metal-$CO_2$ battery 10 and the reaction unit 40. The hydrogen gas separator 80 is configured to separate the protons from the product D discharged from the cathode 12 and to provide the remaining product D', from which the protons have been removed, to the reaction unit 40.

The hydrogen gas separator 80 may include a vapor-liquid separator configured to separate the protons from the product D.

The aqueous alkali bicarbonate included in the remaining product D' may be precipitated and separated in the form of the alkali bicarbonate by the filtration unit 70 via the reaction unit 40, as described above.

The system is characterized in that it is configured to: store carbon dioxide in the form of a salt through the reaction unit 40 using the aqueous alkali carbonate solution as the starting material of the second electrolyte B provided to the cathode 12; secondarily store carbon dioxide in the form of the salt through the cathode 12; and recover the carbon dioxide in the form of the salt through the filtration unit 70.

Therefore, the system according to the present disclosure has a remarkably high carbon dioxide throughput compared to the conventional systems.

Hereinafter, the present disclosure is described in more detail through the following examples. The following examples serve merely to exemplarily describe the present disclosure and are not intended to limit the scope of the disclosure.

EXAMPLE

A system having the configuration shown in FIG. 1 was constructed. Zinc foil was used as an anode, and nickel-molybdenum supported on a support was used as a cathode. A Nafion membrane serving as a separator was interposed between the anode and the cathode, and thereby, a battery was prepared.

A 6 M aqueous NaOH solution was supplied to the anode.

A precursor material was manufactured by supplying a 1 M aqueous $Na_2CO_3$ solution and a 20% (v/v) $CO_2/N_2$ gas mixture to a reaction unit and reacting them. Here, the gas mixture was mixed with 0.3 L of the 1 M aqueous $Na_2CO_3$ solution at a flow rate of 40 mL/min.

Figure 2:
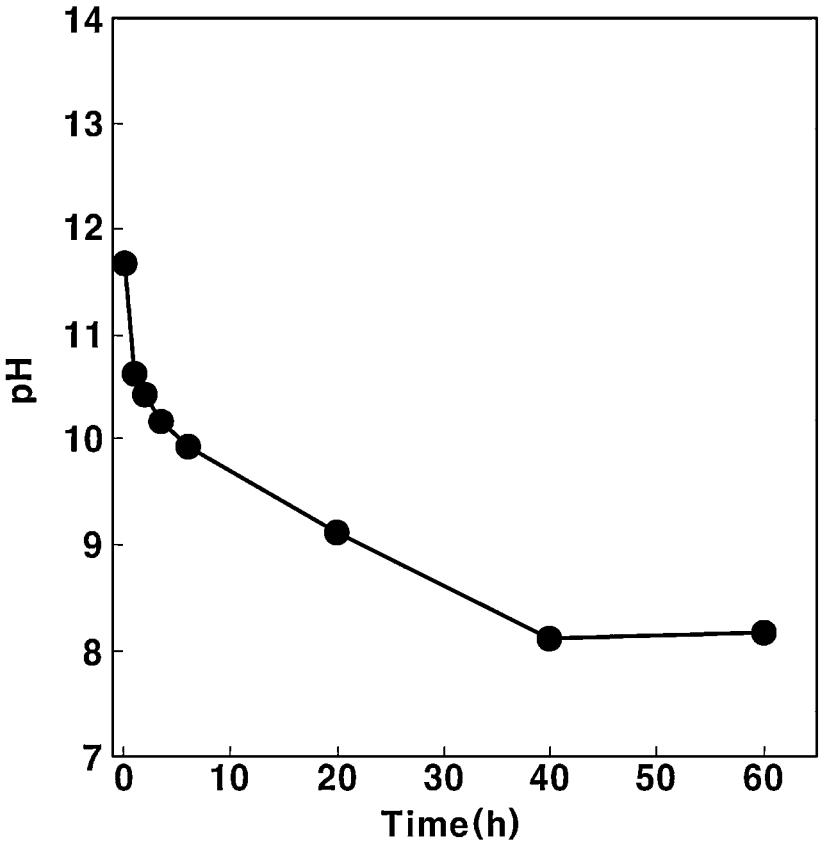
FIG. 2 shows changes in the pH of a precursor material according to an example.

FIG. 2 shows changes in the pH of the precursor material. Referring to this figure, it may be confirmed that the pH of the 1 M aqueous $Na_2CO_3$ solution was changed from about 11.8 to about 8.2, as carbon dioxide was dissolved therein. The pH was calculated by the Henderson-Hasselbalch equation.

The precursor material was converted into a second electrolyte by a filtration unit, and the second electrolyte was supplied to the cathode.

COMPARATIVE EXAMPLE

A system having the same configuration as in Example was constructed, except that a 1 M aqueous $NaHCO_3$ solution was supplied to a reaction unit.

Figure 3:
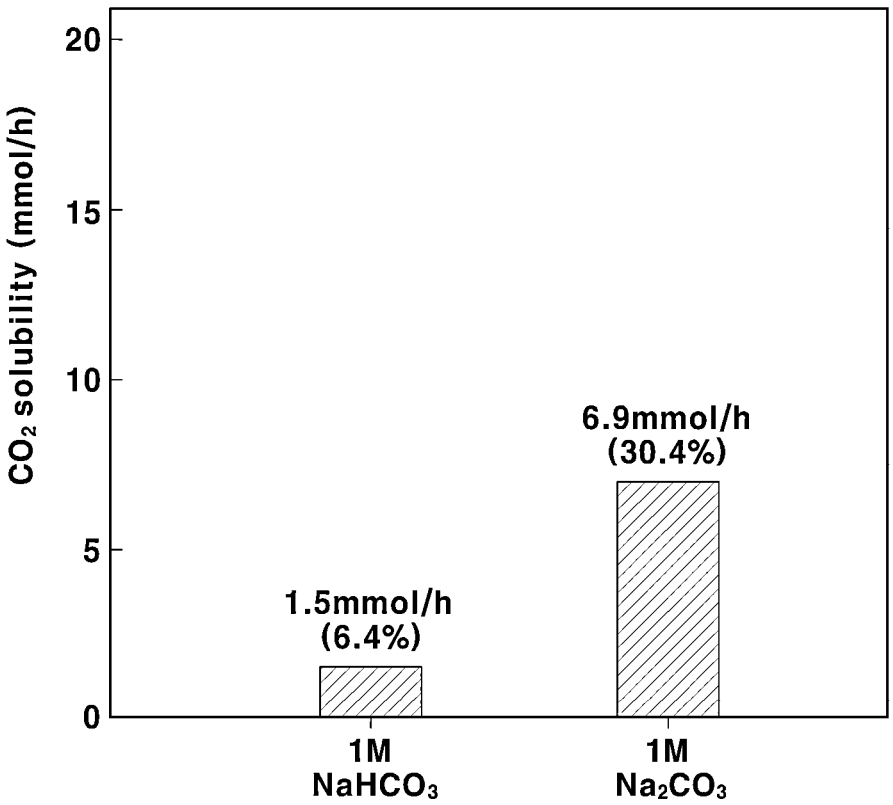
FIG. 3 shows the amounts of carbon dioxide dissolved in reaction units of systems according to an example and a comparative example.

FIG. 3 shows the amounts of carbon dioxide dissolved in the reaction units of the systems according to Example and Comparative Example. Referring to this figure, it may be confirmed that the system according to Example, in which the 1 M aqueous $Na_2CO_3$ solution was used, exhibited higher solubility of carbon dioxide than the system according to the Comparative Example.

Figure 4:
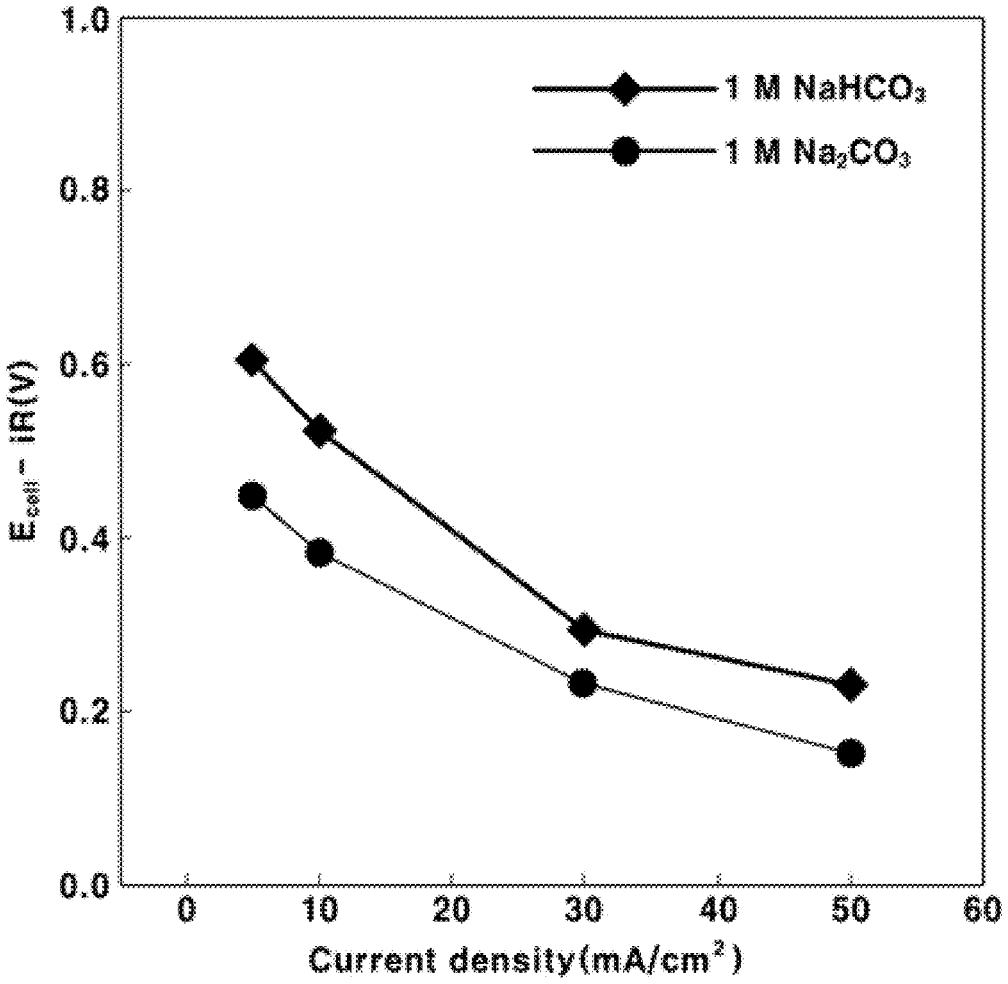
FIG. 4 shows the current-voltage characteristics of the systems according to an example and a comparative example.

FIG. 4 shows the current-voltage characteristics of the systems according to Example and Comparative Example. Referring to this figure, it may be confirmed that the system according to Comparative Example exhibited a higher current density and higher voltage than the system according to Example, in which the 1 M aqueous $Na_2CO_3$ solution was used.

As is apparent from the above description, the present disclosure may provide a hydrogen generation and carbon dioxide storage system that has an improved carbon dioxide throughput compared to the conventional systems.

Further, the present disclosure may provide a hydrogen generation and carbon dioxide storage system which has an increased alkali bicarbonate output compared to the conventional systems.

The disclosure has been described in detail with reference to embodiments thereof. However, it will be appreciated by those having ordinary skill in the art that changes may be made in these embodiments without departing from the principles and spirit of the present disclosure.

What is claimed is:

1. A hydrogen generation and carbon dioxide storage system comprising:

a metal-carbon dioxide battery comprising an anode, a cathode, and a separator interposed between the anode and the cathode;

a first supplier configured to provide a first electrolyte to the anode;

a second supplier configured to provide a second electrolyte comprising protons, an aqueous alkali carbonate solution, and an aqueous alkali bicarbonate solution to the cathode;

a reaction unit configured to manufacture a precursor material by reacting starting materials comprising the aqueous alkali carbonate solution and carbon dioxide;

a third supplier configured to provide the aqueous alkali carbonate solution to the reaction unit;

a fourth supplier configured to provide the carbon dioxide to the reaction unit; and a hydrogen gas separator configured to separate hydrogen gas from a product discharged from the cathode and to provide a remainder of the product to the reaction unit.

2. The hydrogen generation and carbon dioxide storage system of claim 1, wherein the anode comprises aluminum, zinc, or a combination thereof.

3. The hydrogen generation and carbon dioxide storage system of claim 1, wherein the cathode comprises carbon paper, carbon fiber, carbon felt, carbon fabric, metal foam, a metal film, or combinations thereof.

4. The hydrogen generation and carbon dioxide storage system of claim 1, wherein the cathode comprises a catalyst metal supported on a support.

5. The hydrogen generation and carbon dioxide storage system of claim 4, wherein the catalyst metal comprises platinum (Pt), nickel (Ni), or molybdenum (Mo).

6. The hydrogen generation and carbon dioxide storage system of claim 1, wherein the separator of the metal-carbon dioxide battery comprises a cation conductive resin.

7. The hydrogen generation and carbon dioxide storage system of claim 1, wherein the first electrolyte comprises an aqueous sodium hydroxide solution, an aqueous potassium hydroxide solution, or a combination thereof.

8. The hydrogen generation and carbon dioxide storage system of claim 1, wherein the aqueous alkali carbonate solution comprises an aqueous sodium carbonate ($Na_2CO_3$) solution, an aqueous potassium carbonate ($K_2CO_3$) solution, or a combination thereof.

9. The hydrogen generation and carbon dioxide storage system of claim 1, wherein the aqueous alkali bicarbonate solution comprises an aqueous sodium bicarbonate ($NaHCO_3$) solution, an aqueous potassium bicarbonate ($KHCO_3$) solution, or a combination thereof.

10. The hydrogen generation and carbon dioxide storage system of claim 1, wherein the second electrolyte further comprises bicarbonate ions ($HCO_3$) and carbon dioxide.

11. The hydrogen generation and carbon dioxide storage system of claim 1, wherein the second electrolyte has a pH in a range of 8 to 9.

12. The hydrogen generation and carbon dioxide storage system of claim 1, wherein the second supplier is configured to provide the second electrolyte to the cathode at a temperature in a range of 0° C. to 25° C.

13. The hydrogen generation and carbon dioxide storage system of claim 1, wherein the precursor material comprises the aqueous alkali bicarbonate solution, and wherein the aqueous alkali bicarbonate solution is in a supersaturated state.

14. The hydrogen generation and carbon dioxide storage system of claim 1, wherein the aqueous alkali bicarbonate solution in the second electrolyte is in a saturated state.

15. The hydrogen generation and carbon dioxide storage system of claim 1, wherein the third supplier provides a 0.5 M to 3 M aqueous alkali carbonate solution to the reaction unit.

16. The hydrogen generation and carbon dioxide storage system of claim 1, wherein the third supplier is configured to provide 0.1 moles to 1 mole of the aqueous alkali carbonate solution to the reaction unit based on 1 mole of hydrogen gas discharged from the hydrogen gas separator.

17. The hydrogen generation and carbon dioxide storage system of claim 1, further comprising:

a filtration unit located between the reaction unit and the second supplier, wherein the filtration unit is configured to precipitate and separate an alkali bicarbonate from the precursor material supplied from the reaction unit so as to manufacture the second electrolyte and to provide the second electrolyte to the second supplier.

18. The hydrogen generation and carbon dioxide storage system of claim 17, wherein the filtration unit comprises:

a cooler configured to reduce a temperature of the precursor material so as to precipitate the alkali bicarbonate from the precursor material; and a filter configured to separate the precipitated alkali bicarbonate.

* * * * *